US006645005B2

(12) United States Patent
Wu

(10) Patent No.: US 6,645,005 B2
(45) Date of Patent: Nov. 11, 2003

(54) ELECTRICAL CONNECTOR ASSEMBLY WITH LATCHING METAL EARS

(75) Inventor: Min-Fang Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/017,843

(22) Filed: Nov. 29, 2001

(65) Prior Publication Data

US 2003/0100211 A1 May 29, 2003

(51) Int. Cl.[7] ..... H01R 13/73
(52) U.S. Cl. ..... 439/563; 439/74
(58) Field of Search ..... 439/563, 566, 439/564, 565, 570, 74, 83, 65, 328

(56) References Cited

U.S. PATENT DOCUMENTS 5,120,256 A * 6/1992 Walden ..... 439/553
5,395,265 A * 3/1995 DiMondi et al. ..... 439/553
5,697,799 A * 12/1997 Consoli et al. ..... 439/607
5,971,809 A * 10/1999 Ho ..... 439/660
6,250,935 B1 * 6/2001 Mochizuki et al. ..... 439/74

* cited by examiner

*Primary Examiner*—Hien Vu
(74) *Attorney, Agent, or Firm*—Wei Te Chung

(57) ABSTRACT

A board to board connector assembly includes a plug connector (1) and a receptacle connector (5) engaged with each other. The plug connector has a first housing (2), a plurality of first terminals (3) received in the first housing, and a pair of first metal ears (40) attached on the first housing. One of the first metal ears has an upwardly extending first metal latch (41) with a projecting portion (412) formed thereon. The receptacle connector has a second housing (6), a plurality of second terminals (7) received in the second housing, and a pair of second metal ears (80) assembled on the second housing. One of the second metal ears has a downwardly extending second metal latch (81) with a receiving window (812) defined thereon for receiving the projecting portion.

5 Claims, 6 Drawing Sheets

ELECTRICAL CONNECTOR ASSEMBLY WITH LATCHING METAL EARS

BACKGROUND OF THE INVENTION

1. Field of the Invention

The present invention generally relates to an electrical connector assembly, and particularly to a board to board connector assembly having metal latches for providing reliable mating and grounding.

2. Description of Related Art

Electrical connector assembly for connecting one Printed Circuit Board (PCB) to another PCB is widely used in computer, notebook and other electrical products. U.S. Pat. No. 5,556,286 discloses a conventional board to board connector assembly. Usually, a conventional board-to-board connector assembly includes a female connector, which is referred to as a receptacle and fixed to one PCB, and a corresponding male connector, which is referred to as a plug and fixed to the other PCB. Each of the plug and receptacle has an elongated insulative housing and a plurality of conductive terminals arranged within the housing at predetermined intervals. The housing has two elongated longitudinal sidewalls and two transverse sidewalls. A pair of metal ears are attached on the two transverse sidewalls for soldering to the PCB to provide fixation and grounding. The plug and receptacle engage with each other by a press-fit engagement.

As understood from the above, it can be appreciated that conventional board-to-board connector assembly has the following disadvantages. First, after the plug and receptacle are mated with each other, when an unexpected external force is exerted on the PCB, the retention force between the plug and receptacle may not be sufficient to maintain the plug in the receptacle, and the plug may disconnect from the receptacle. Secondly, conventional board to board connectors often attach shields on the longitudinal sidewalls for grounding and preventing Electromagnetic Interference (EMI), but because the transverse sidewalls are very short, they usually have no shield thereon. Therefore, the connectors have an insufficient prevention from EMI, and the performance of the connectors is adversely affected.

The present invention overcomes these disadvantages and provides benefits over the prior art by providing an additional metal latch on the metal ear to improve the reliability of the mating and EMI characteristics.

SUMMARY OF THE INVENTION

Accordingly, one object of the present invention is to provide a board to board connector assembly which has latches to improve mating reliability between a plug and a receptacle thereof.

Another object of the present invention is to provide a board to board connector assembly having metal latches to improve the grounding and EMI characteristics.

In order to achieve the objects set forth, an electrical connector assembly for connecting one Printed Circuit Board to another Printed Circuit Board comprises a plug connector and a receptacle connector. The plug connector has a first insulative housing comprising a pair of longitudinal sidewalls and a pair of transverse sidewalls, a plurality of first terminals received in the longitudinal sidewalls, and a pair of first metal ears attached on the transverse sidewalls. One of the first metal ears has an upwardly extending metal latch. The receptacle connector engaged with the plug connector has a second insulative housing comprising a base and a tongue protruding downwardly from the base and being received between the pair of longitudinal sidewalls of the first insulative housing, a plurality of second terminals retained on the tongue, and a pair of second metal ears attached on opposite ends of the base. One of the second metal ears has a second metal latch engaged with the first metal latch.

Other objects, advantages and novel features of the invention will become more apparent from the following detailed description when taken in conjunction with the accompanying drawings.

DETAILED DESCRIPTION OF THE INVENTION

Figure 1:
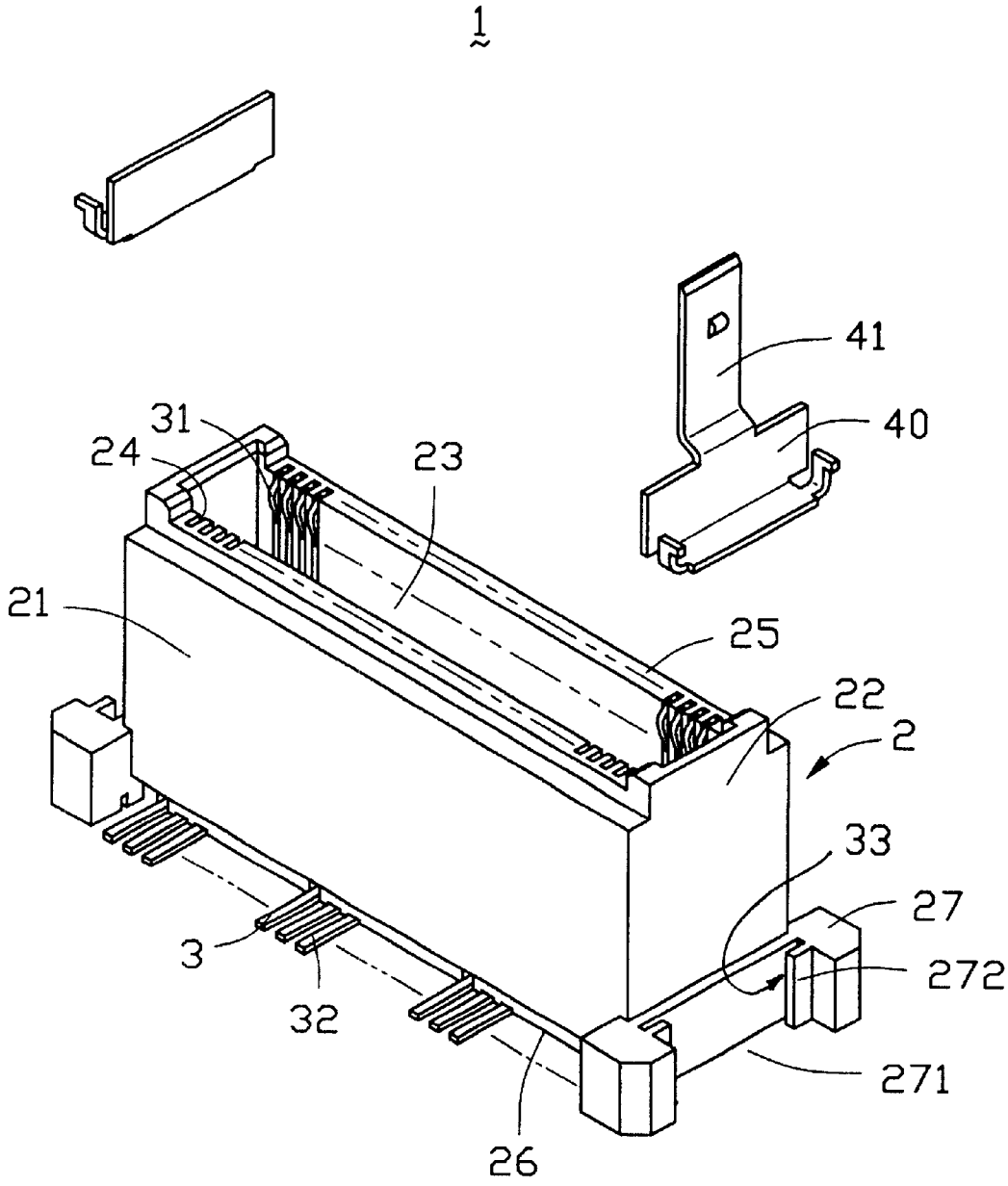
FIG. 1 is a perspective view of a plug connector of an electrical connector assembly constructed in accordance with the present invention, particularly showing a pair of first metal ears unassembled.
Figure 2:
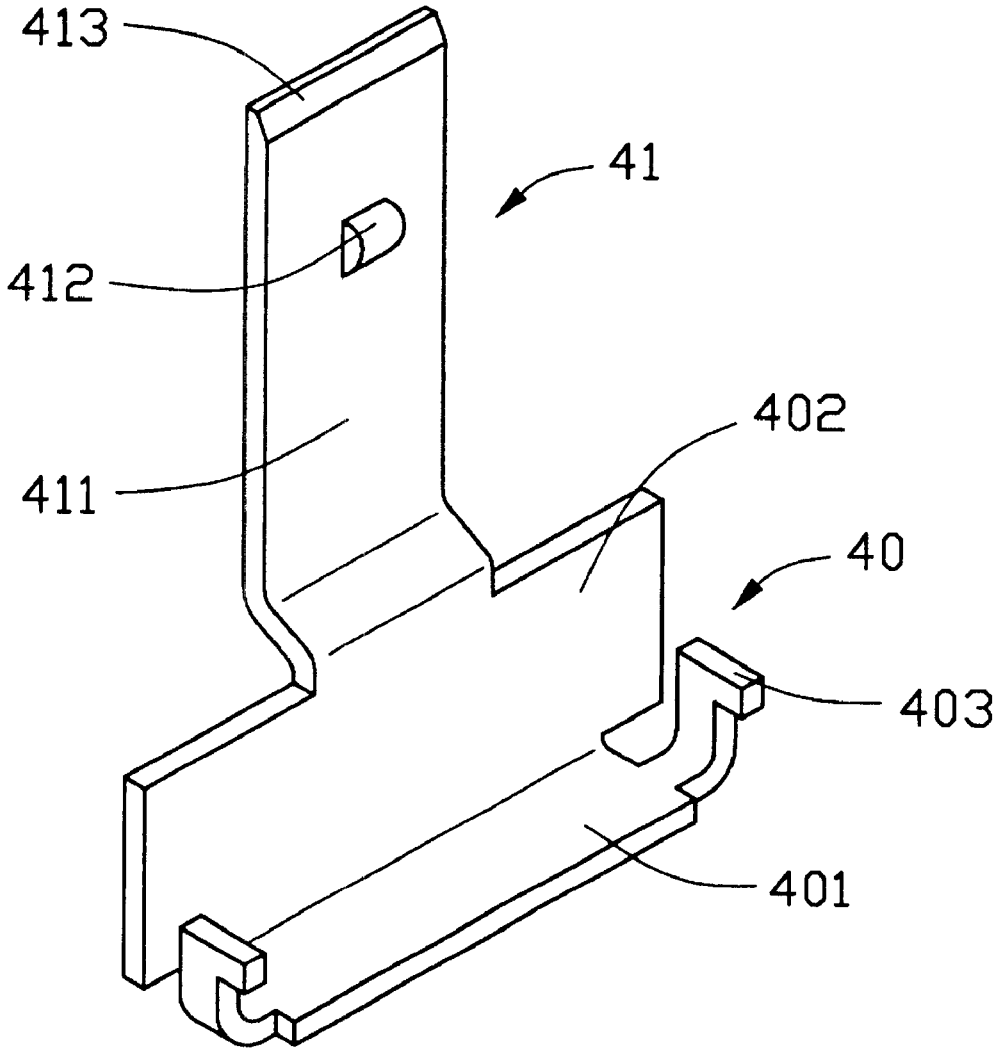
FIG. 2 is an enlarged perspective view of one metal ear of the plug connector shown FIG. 1.

An electrical connector assembly of the present invention includes a plug connector 1 and a mating receptacle connector 5. Referring to FIGS. 1 and 2, the plug connector 1 comprises an elongated insulative housing 2, a plurality of electrical terminals 3, and a pair of metal ears 40. One metal ear 40 has a metal latch 41. The insulative housing 2 has a pair of longitudinal sidewalls 21 and a pair of transverse sidewalls 22 together defining a cavity 23 therebetween. A plurality of terminal receiving passageways 24 are defined within the longitudinal sidewalls 21 and run through the insulative housing 2 from an upper side 25 to a lower side 26. Each terminal 3 is general L-shaped and defines a vertical mating portion 31 and a horizontal soldering portion 32. The vertical mating portion 31 is received in a corresponding terminal receiving passageway 24 and the horizontal soldering portion 32 extends outside of the lower side 26 of the insulative housing 2. The horizontal soldering portion 32 is to be soldered to a contact pad located on an upper surface of a first circuit board (not shown). The plug connector 1 has a pair of shields (not shown) attached on the outer sides of the two longitudinal sidewalls 21.

The insulative housing 2 further has a flange 27 at each transverse sidewall 22. The flanges 27 have flat bottom surfaces coplanar with the lower side 26. Each flange 27 defines a recess 271 in an outer side, and a pair of elongated blocks 272 extending into the recess 271.

Each metal ear 40 is assembled on the insulative housing 2 by engaging within the slot 33 inside of the flange 27, and comprises a soldering portion 401 and a base portion 402 perpendicular to each other. Each end of the soldering portion 401 is bent outwardly to form an arm 403. The metal latch 41 extends upwardly from the base portion 402 of the metal ear 40. The metal latch 41 comprises a flat portion 411 and a projecting portion 412 projecting form the flat portion 411. The flat portion 411 has an outer inclined surface 413 at an upper end thereof.

Figure 3:
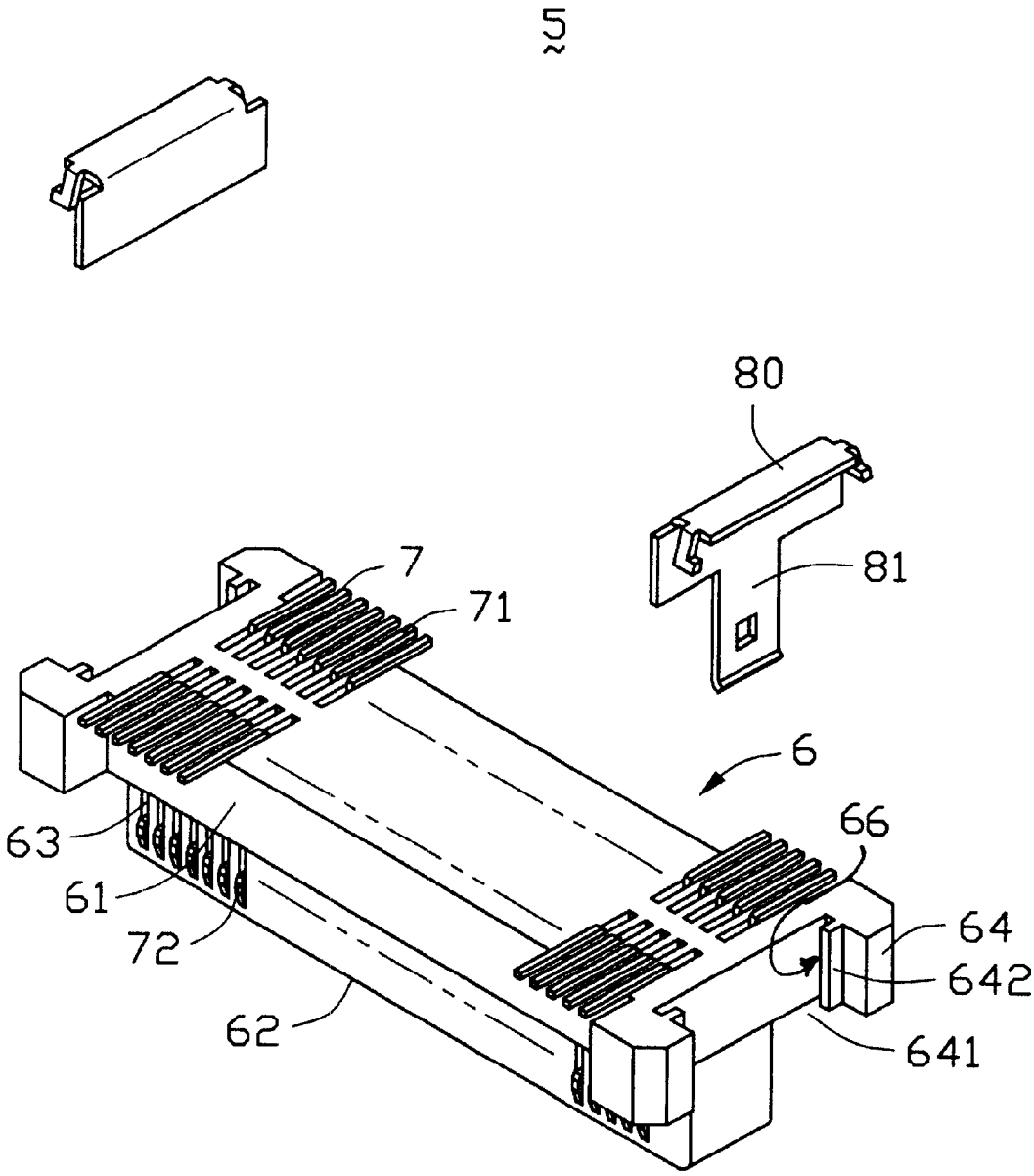
FIG. 3 is a perspective view of a receptacle connector of an electrical connector assembly constructed in accordance with the present invention, with a pair of second metal ears unassembled.
Figure 4:
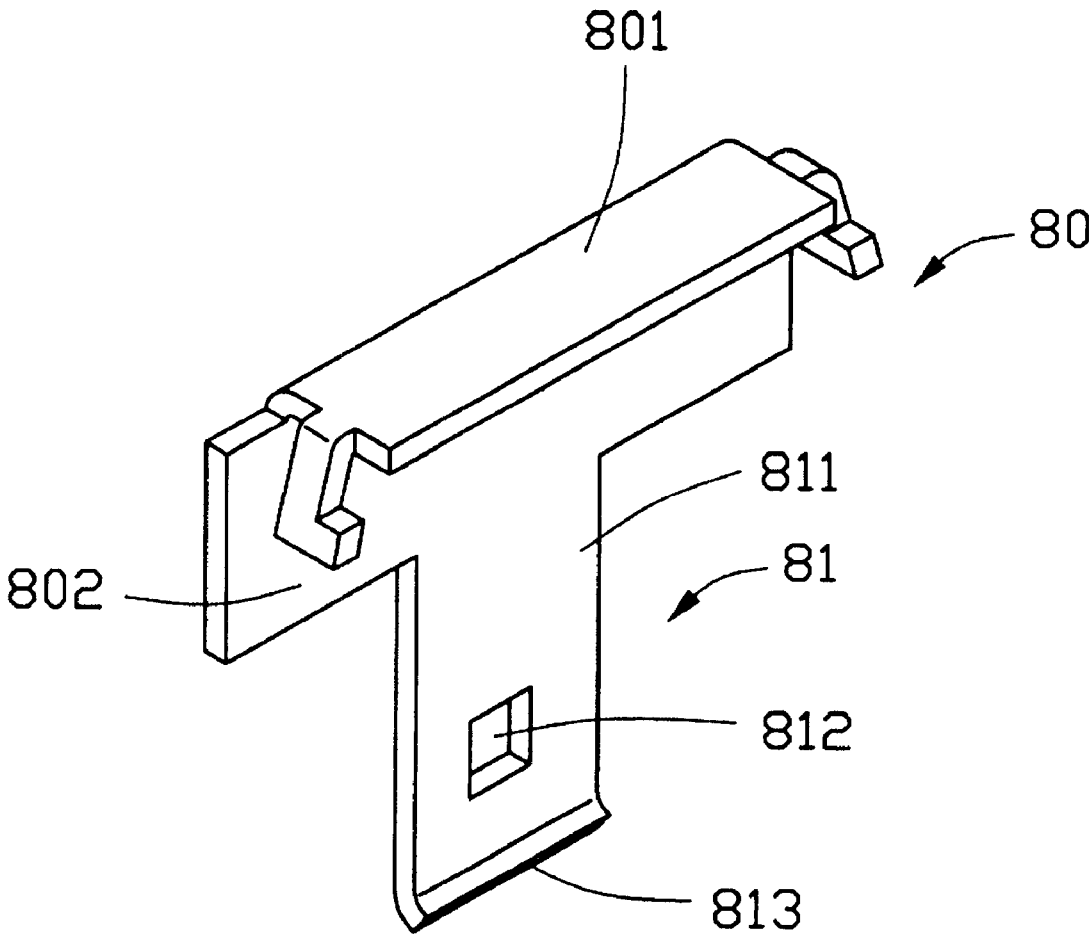
FIG. 4 is an enlarged perspective view of one metal ear of the receptacle connector shown in FIG. 3.

Referring to FIG. 3 and FIG. 4, the receptacle connector 5 is provided for engagement with the plug connector 1 and also includes an elongated insulative housing 6, a plurality of electrical terminals 7 and a pair of metal ears 80. One of the metal ears 80 has a metal latch 81 corresponding to the metal latch 41. The insulative housing 6 includes a base 61 and a tongue 62 protruding downwardly form the base 61. A plurality of terminal receiving passageways 63 are defined in opposite sides of the tongue 62 and run through the base 61. The plurality of terminals 7 are received in the corresponding terminal receiving passageways 63. Each terminal 7 comprises a soldering portion 71 and a mating portion 72. The soldering portion 71 is to be soldered to a contact pad located on a lower surface of a second circuited board (not shown), and the mating portion 72 is received in a corresponding terminal receiving passageway 63.

The insulative housing 6 also includes a flange 64 at each end of the base 6. Each flange 64 has a height equal to that of the base 61. Each flange 64 defines a recess 641 in an outer side, and a pair of elongated blocks 642 projecting into the recess 641.

The metal ear 80 assembled into the slot 66 inside of the flange 64 has a shape similar to the metal ear 40, and comprises a soldering portion 801 and a base portion 802 perpendicular to each other. The metal latch 81 extends from the base portion 802. The metal latch 81 comprises a flat portion 811 and a receiving window 812 corresponding to the projecting portion 412 of the metal latch 41. The lower end 813 of the flat portion 811 inclines outwardly.

Figure 5:
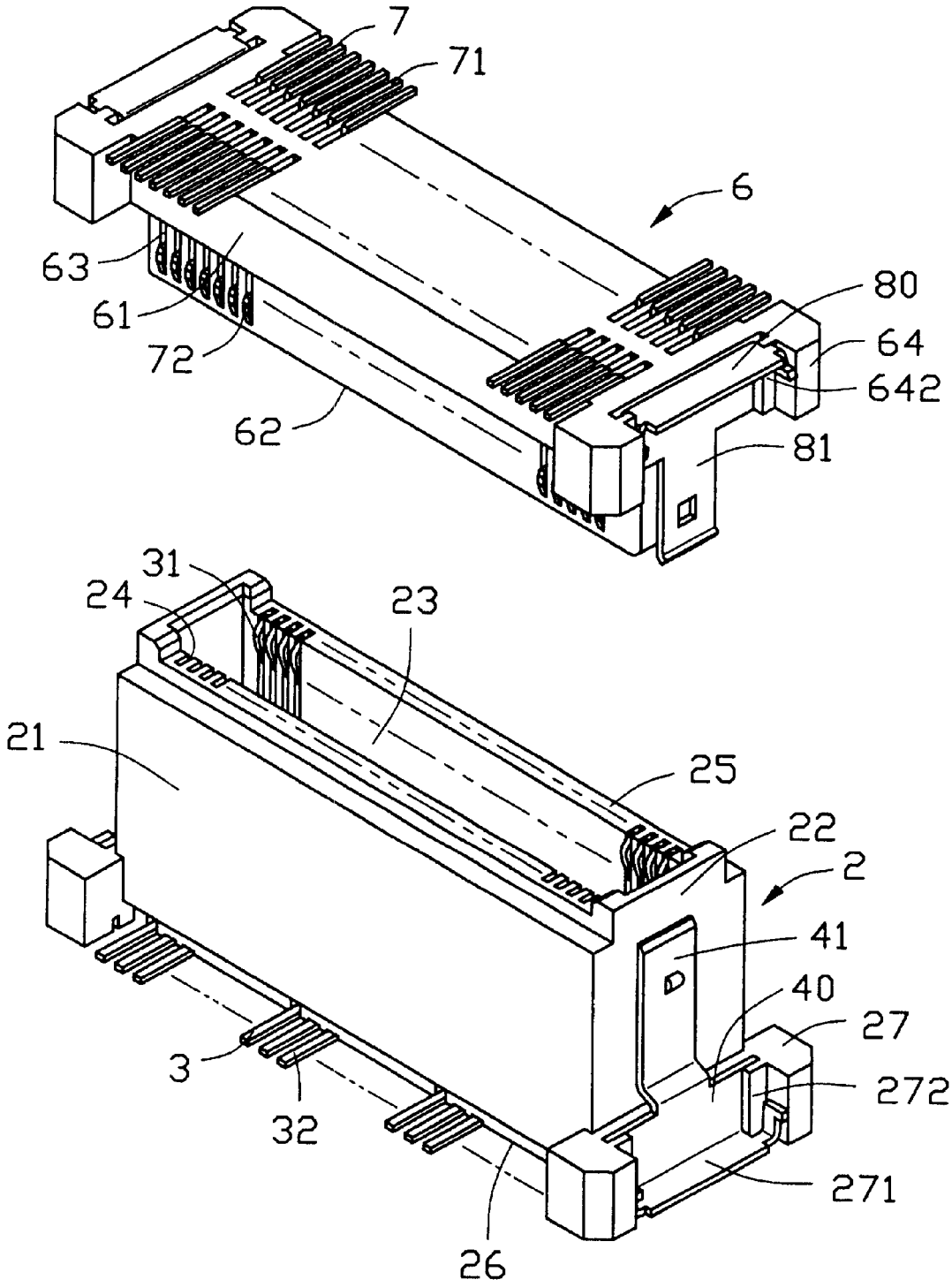
FIG. 5 is a perspective view showing the plug connector unmated with the receptacle connector.
Figure 6:
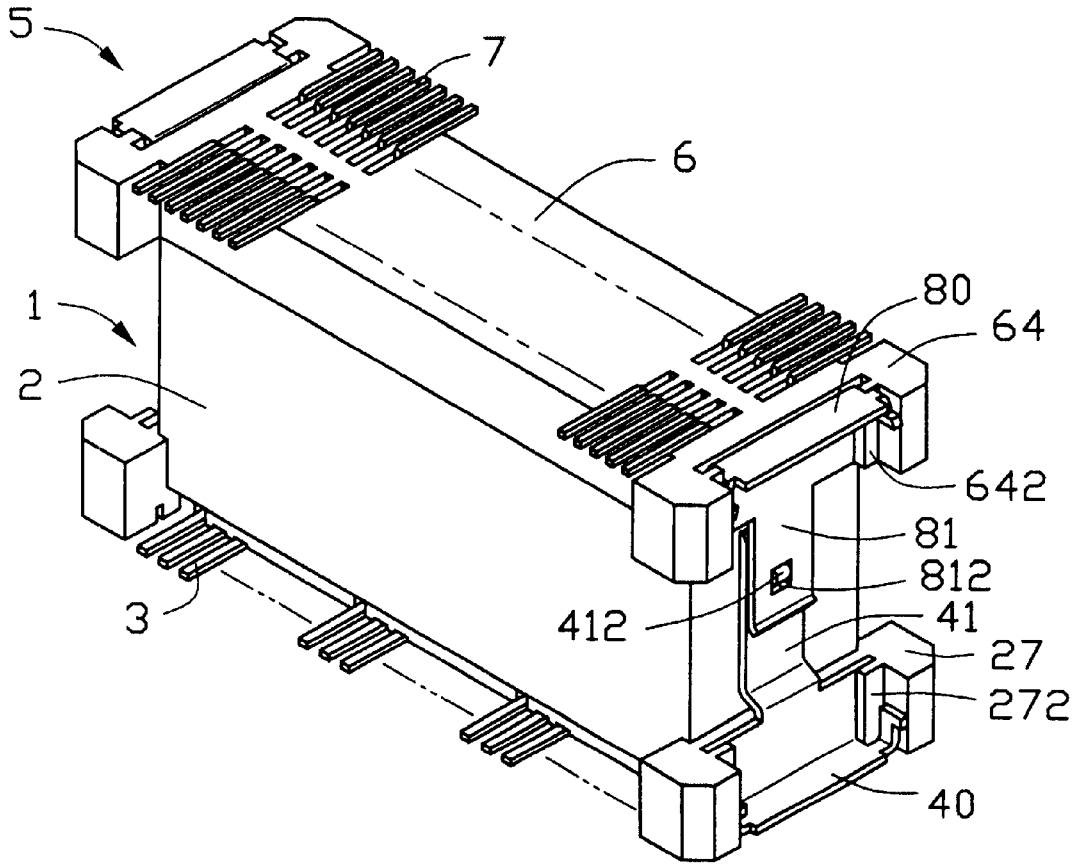
FIG. 6 is an assembled view of FIG. 5.

In assembly, referring to FIGS. 5 and 6, the tongue 62 of the receptacle connector 5 is received in the cavity 23 of the plug connector 1, and the mating portions 31, 72 of the respective terminals 3, 7 are electrically connected to each other. The metal ear 40, 80 each is pre-assembled in the flange 27, 64 by inserting the base portion 402, 802 into individual slot defined between the bottom surface of the recess 271, 641 and the elongated block 272, 642. The flat portion 811 overlaps the flat portion 411, and the projecting portion 412 is received and locked in the receiving window 812.

The mating between the plug and receptacle connectors is very reliable because the latches 41, 81 are locked firmly. After the soldering portions 401, 801 of the metal ears 40, 80 are soldered to the first and second PCBs to ground, the board to board connector has a better grounding and shielding performance than the conventional design.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly for connecting a first printed circuit board to a second printed circuit board, comprising:

a plug connector comprising a first insulative housing having a pair of longitudinal sidewalls and a pair of transverse sidewalls, a plurality of first teminals received in the longitudinal sidewalls, and a pair of first metal ears attached on the transverse sidewalls, one of the first metal ears having an upwardly extending first metal latch; and a receptacle connector engaged with the plug connector, the receptacle connector comprising a second insulative housing having a base and a tongue protruding downwardly from the base, the tongue being received between the pair of longitudinal sidewalls of the first insulative housing, a plurality of second terminals retained on the tongue, and a pair of second metal ears attached on opposite ends of the base, one of the second metal ears having a second metal latch engaged with the first metal latch; wherein the first insulative housing has a first flange formed on each transverse sidewall, the first flange comprising a recess defined in an outer side thereof and a pair of elongated blocks projecting into the recess, and wherein the first metal ear is received in the recess of the first flange and engages with the elongated blocks; wherein the first metal ear comprises a first horizontal soldering portion and a first base portion perpendicular to each other, the first metal latch having a flat portion extending upwardly from the first base port; wherein the first horizontal soldering portion comprises an upwardly and outwardly bent arm at each end thereof; wherein the first flat portion of the first metal latch comprises an outer inclined surface at an upper and thereof.

2. The electrical connector assembly as described in claim 1, wherein the second metal latch comprises a flat portion and a receiving window defined in the flat portion, the receiving window receiving the projecting portion of the first metal latch.

3. The electrical connector assembly as described in claim 2, wherein the second metal latch has a lower end inclining outwardly.

4. The electrical connector assembly as described in claim 1, wherein the second insulative housing includes a second flange at each end of the base, and wherein the second metal ear is assembled in the second flange.

5. The electrical connector assembly as described in claim 1, wherein the second metal ear comprises a second soldering portion and a second base portion perpendicular to each other, the second metal latch extending downwardly from the second base portion.

* * * * *